US005560239A

United States Patent [19]

Conlan

[11] Patent Number: 5,560,239

[45] Date of Patent: Oct. 1, 1996

[54] FISH TAPE RESTORER

[76] Inventor: William A. Conlan, 10700 Santa Lucia Rd., Atascadero, Calif. 93422

[21] Appl. No.: 320,684

[22] Filed: Oct. 11, 1994

[51] Int. Cl.[6] ..... B21D 1/10

[52] U.S. Cl. ..... 72/160

[58] Field of Search ..... 72/160–165

[56] References Cited

U.S. PATENT DOCUMENTS

| | | | |
|---|---|---|---|
| 2,307,133 | 1/1943 | Johnson | 72/165 |
| 2,313,111 | 3/1943 | Wilson | 72/164 |
| 2,318,160 | 5/1943 | Johnson | 72/165 |
| 3,206,962 | 9/1965 | Buralli | 72/161 |
| 3,245,244 | 4/1966 | Polakowski | 72/163 |
| 3,282,304 | 11/1966 | Coleman | 72/160 |
| 3,605,471 | 9/1971 | Bodtke | 72/165 |

FOREIGN PATENT DOCUMENTS

| | | | |
|---|---|---|---|
| 2550973 | 3/1985 | France | 72/164 |
| 529198 | 7/1931 | Germany | 72/165 |
| 161803 | 7/1933 | Switzerland | 72/160 |
| 195295 | 3/1969 | U.S.S.R. | 72/164 |
| 765707 | 1/1957 | United Kingdom | 72/160 |

*Primary Examiner*—Daniel C. Crane

[57] ABSTRACT

The principal effect and objective of this present invention is to furnish a quality hand held tool made to last, that is easily used for the straightening of a fish tape. Additionally when properly used this tool will remove the kinks, bends and curls which occur to the fish tape. Furthermore this present invention will renew the fish tape with each use. This present invention consists of a series of metal pins placed in line with each other and evenly spaced, giving the fish tape something to be woven over. The pins are unitary with one side of the tool. When both sides of the tool are properly assembled and secured together, having the fish tape enclosed within the tool, this present invention is pulled along the length of the fish tape until satisfactory restoration is complete. Its that simple.

1 Claim, 1 Drawing Sheet

FISH TAPE RESTORER

BACKGROUND OF INVENTION

1. Field of Invention

This invention relates in general to a tool useful in the Electrical Industry and in particular a tool used to restore a bent, kinked or curled fish tape to almost new condition.

2. Prior Art

I have been in the Electrical Industry over 20 years and used or worn out many tools. Among the tools used by an Electrician is a "Fish Tape". The fish tape is almost always purchased by the Employer and provided for the employee. The employer normally provides everything but the basic hand tools.

Employers expend lots of money for tools and the longer they last, the more life the employer gets out of his tools, the more profit he can make. Profit makes an employer happy, and its nice to work for happy employers.

The fish tape is used by the Electrician for pulling wire into a conduit system. The fish tape is pushed from one end of the conduit system to the other. The wire is then attached to the end of the fish tape. Then while one Electrician pulls on the fish tape another Electrician feeds the wire into the conduit system. Ideally everything goes smoothly. Occasionally, when the wire pull is anything but smooth, anything but the correct tool is used to grab the fish tape to help pull it and the wire through the conduit. This is when the kinks, bends or curls begin to show up in the fish tape. These blemishes cause the fish tape to drag the next time it is used, which cause even more disfigurements because the previous ones have not been repaired. These blemishes cause drag or resistance when trying to push or pull the fish tape through a conduit system. This wastes time and is very frustrating. Tools are designed to bring down labor costs. The fish tape is one tool that is very time saving to use and can be repaired.

There are a number of ways to straighten the fish tape. One way is to get a short piece of wood and drive a series of nails into it. Then weave the fish tape through the nails and begin pulling the length of the fish tape through the nails. This method works fine but it seems that every time a fish tape needs to be straightened, another "straightener" needs to be made, and this takes time. Another technique for straightening a fish tape is to weave it through the rungs of a ladder. This works fine but it takes two people for this method.

These are just two examples used by electricians to straighten the fish tape.

One person can straighten the fish tape with the use of this present invention and it is easily carried in a tool box. Another advantage of this present invention is to provide the right tool for the job. Its that simple. This hand held tool has a series of metal pins placed in line with each other and evenly spaced giving the fish tape something to be woven over. The metal pins are unitary with one side of this present invention. When both sides of the tool are properly assembled and secured together and the fish tape is enclosed within the tool, this present invention is pulled along the length of the fish tape until satisfactory restoration is complete. Its really that simple.

All of the examples of the prior art related to straightening devices are set forth in the patents below:

U.S. PATENTS

U.S. Pat. No. 4,145,905, Mattie. This machinery is used for controlling bow in Venetian blind slats.

U.S. Pat. No. 4,593,548, Hashimoto et. al. This leveling mill and related machinery is used for correcting distortions in a rolled strip product, during manufacture.

U.S. Pat. No. 4,850,212, Frey. This bending machinery is used for bending pieces of metal or other wire to a predetermined degree of curvature.

U.S. Pat. No. 5,009,097, Del Fabro et. al. This machinery is for straightening-bending and shaping rods or metallic wire.

U.S. Pat. No. 5,067,337, Del Fabro. This machinery is for the controlled and independent rocking of straightening and bending platforms.

FOREIGN PATENTS

Japanese, 3-180209. This machinery is used for working "H" shaped steel.

Japanese, 56-30027. This machinery is used for straightening deformations in "H" shaped steel.

German, 4,024,794. This machinery is similar in design and application to U.S. Pat. No. 4,593,548 mentioned above.

Whatever the precise merits, features, and advantages of the above cited references, none of them achieves, or fulfills the purposes of the Fish Tape Restorer, this present invention. The principal effect and objective of this present invention is to furnish a quality hand held tool made to last. Another accomplishment of this present invention is to provide the correct tool for the job. Additionally this present invention is readily accessible and easily used for the straightening of a fish tape.

SUMMARY OF INVENTION

The principal effect and objective of this present invention is to furnish a quality hand held tool made to last, that is the correct tool for the job. Additionally, when properly used, this present invention will remove the kinks, bends and curls which occur to the fish tape. Furthermore this present invention will renew the fish tape with each use, saving the employee time and frustration and the employer money.

DETAILED DESCRIPTION OF INVENTION

Figure 3:
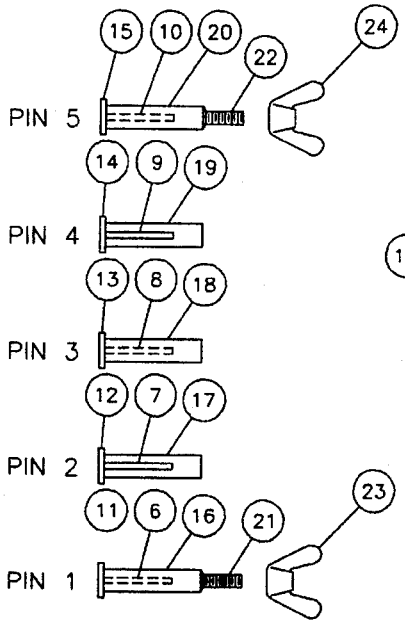
FIG. 3. This is a detail of the pins. It is shown in a side view.
Figure 1:
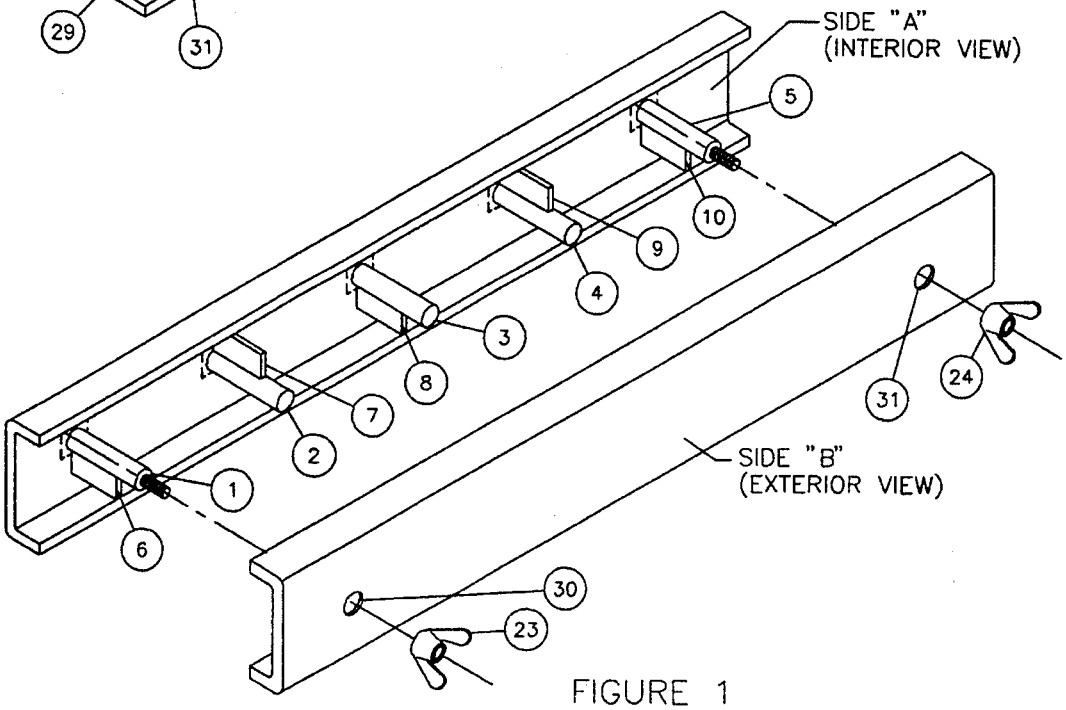
FIG. 1. This is a complete exploded view of the fish tape restorer. It is shown in a perspective view.

Refer now to FIG. 1 which is an overall exploded view of a preferred embodiment of the invention. The number of metal pins and shape of tool are preferred because of its simplicity, function and size. Notice that the series of pins are evenly spaced. It is shown in FIG. 3 that shoulders 16 through 20 are of the same diameter and length for pins 1 through 5. FIGS. 1 and 3 also illustrate that pins 1 and 5 have machine threads 21 and 22 on one end, which are of a smaller outside diameter than shoulders 16 and 20 of these respective pins. FIG. 3 further illustrates that wing nuts 23 and 24 are used on pins 1 and 5 to secure side 'B' to side 'A'. Wing nuts 23 and 24 are the same thread type as machine thread 21 and 22 on the end of pins 1 and 5. Refer to FIG.

Figure 4:
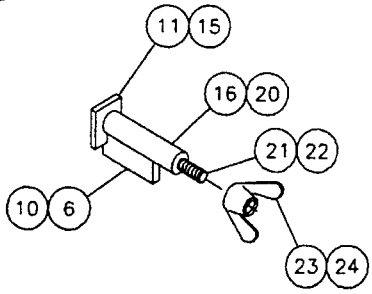
FIG. 4. This is a detail of the end pins, showing the complete pin. It is shown in a perspective view.
Figure 5:
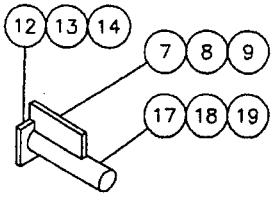
FIG. 5. This is a detail of the middle pins, showing the complete pin. It is shown in a perspective view.

4 for a detailed perspective view of the end pins, pins 1 and 5, showing the complete pin. Refer to FIG. 5 for a detailed perspective view of the middle pins, pins 2, 3 and 4, showing the complete pin. FIGS. 3, 4 and 5 show the differences between pins 1 and 5, the end pins, and pins 2,3, and 4, the middle pins. FIGS. 4 and 5 further illustrate that pins 1 through 5 have square heads, 11 through 15, and that shoulders 16 through 20 of pins 1 through 5 are of the same outside diameter and length.

It is suggested that the heads of all of the pins, 1 through 5 are square as shown in FIGS. 4 and 5. This is preferred because once side A is formed around the square heads, 11 through 15, of all the pins, 1 through 5, the square head prevents each pin from spinning while the tool is in use. The square heads, 11 through 15, of all the pins, 1 through 5, are embedded into the material of which side A is made.

The only visible part of the pins, 1 through 5, protruding from side A are shoulders 16 through 20 and machine threads 21 and 22, as shown in FIG. 1. Pins 1 through 5 thus become unitary with side A.

FIG. 1 shows that sides A and B are "U" shaped or "U" channeled in shape. It is suggested that sides A and B are formed or molded into the same "U" shape.

Notice in FIG. 1 that pins 1 through 5 are each supported by a gusset, 6 through 10, which are unitary with side A. It is suggested that gussets 6, 8 and 10 are formed under pins 1,3 and 5 and gussets 7 and 9 are formed on top of pins 2 and 4, as illustrated in FIG. 1. It is suggested that gussets 6 through 10 are formed narrower in width than the diameter of shoulders 16 through 20 of pins 1 through 5. It is further suggested that gussets 6 through 10 are made slightly shorter in length than the protruding shoulders 16 through 20 of pins 1 through 5. This allows pins 1 through 5 to seat into their respective end supports 25 through 29, which are unitary with side B, before the front of gussets 6 through 10 touch the inside of side B. Shoulders 16 through 20 of pins 1 through 5 protruding out of side A are of the same finished length. The shoulders 16 through 20 of pins 1 through 5 will bottom out in their respective end supports 25 through 29 at the same time. The bottom of gussets 6, 8 and 10 and the top of gussets 7 and 9 will rest on the "U" side of side B once side B has been secured in place to side A with wing nuts 23 and 24. This arrangement strengthens the support that gussets 6 through 10 provide and keeps side A and side B from moving vertically once they have been secured together with wing nuts 23 and 24.

Figure 2:
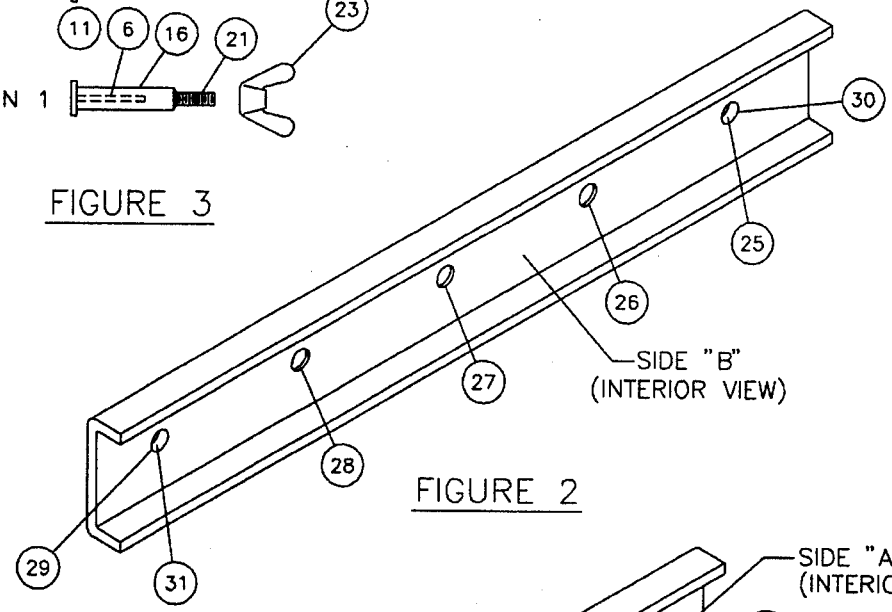
FIG. 2. This is a view of the end supports and through holes for the pins. It is shown in a perspective view.

The end supports stabilize the free end of all the pins, adding to the tools quality and durability. FIG. 2 shows the end supports, 25 through 29, in side B for the free end of pins 1 through 5. It is suggested that the depth of end supports 25 through 29 is half the thickness of side B. It can also be seen in FIG. 2 that end supports 25 and 29 in side B for pins 1 and 5 are formed with through holes 30 and 31 which are only large enough to allow the machine threads 21 and 22 of pins 1 and 5 to fit through the hole. End supports 26, 27, 28 for pins 2, 3 and 4 are not formed with through holes, and do not penetrate side B. As revealed earlier the depth of end supports 26, 27 and 28 are half the thickness of side B.

It is suggested that pins 1 through 5 are made of a hardened steel to provide years of use without wearing out. Stainless steel is an example of a suggested alloy for the pin material.

A suggestion for construction of the fish tape restorer is by the injection molding process. Side A and gussets 6 through 10 and metal pins 1 through 5 are injection molded as a singular unitary side of this tool, as shown in FIG. 1. The square heads 11 through 15 of the metal pins 1 through 5 as shown in FIGS. 4 and 5, will become permanently embedded into the material of side A thus becoming unitary with side A. Side B and end supports 25 through 29 for pins 1 through 5 including holes 30 and 31 are formed simultaneously with side B and are injection molded as a singular unitary side of this tool, as shown in FIGS. 1 and 2.

When the fish tape is woven through the tool it will rest on the top of shoulders 16, 18 and 20 of pins 1, 3 and 5, and on the bottom of shoulders 17 and 19 of pins 2 and 4, as shown in FIG. 5. Pins 1 through 5 will not flex because gussets 6 through 10 support the pins. Once the fish tape is in place side B can be put in place onto side A. The wing nuts 23 and 24 are threaded onto machine threads, 21 and 22, on the end of pins 1 and 5 which protrude out of holes 30 and 31 of side B and secure the tool together. The tool is now ready for use.

There are other methods of achieving the same end result. These practices, processes, or materials do not limit the way this present invention should or could be made.

The foregoing description of the preferred embodiment of the invention has been presented for the purpose of illustration and description. It is not intended to be exhaustive or to limit the invention to the precise form disclosed. Many modifications and variations are possible in light of the above teaching. It is intended that the scope of the invention be limited not by this Detailed Description, but rather by the Claims appended hereto.

What is claimed is:

1. A hand held device intended for use in the restoration of a fish tape, said hand held device consisting of at least two sides, one of said sides having a series of unitary pins, at least two of said unitary pins having threads on their free ends, said threads having a smaller cross section than said unitary pins, said threads being unitary with said unitary pins, said unitary pins are supported by a series of formed gussets, said unitary pins and said gussets being unitary with said one side, other said side of said hand held device having formed end supports for said free ends of said unitary pins, said other side having at least two through holes formed therein for receipt of the threads of said unitary pins, said end supports and said through holes being unitary with said other side, wherein said other side having said end supports and said through holes fits onto said free ends of said unitary pins and gussets, said free ends fit into said end supports and said threads fit through said through holes, and is secured to said side with said unitary pins and gussets, with fasteners of the same thread type as said threads on free ends of said unitary pins with said threads.

* * * * *